United States Patent [19]

Kinney

[11] Patent Number: 4,806,214

[45] Date of Patent: Feb. 21, 1989

[54] METHOD OF PREPARING AN ASBESTOS DIAPHRAGM

[75] Inventor: Jerry N. Kinney, Painesville, Ohio

[73] Assignee: PPG Industries, Inc., Pittsburgh, Pa.

[21] Appl. No.: 26,810

[22] Filed: Mar. 17, 1987

Related U.S. Application Data

[63] Continuation of Ser. No. 813,326, Dec. 24, 1985, abandoned.

[51] Int. Cl.[4] ..... C25G 1/14

[52] U.S. Cl. ..... 204/98; 204/128; 204/252; 204/283; 204/295

[58] Field of Search ..... 204/98, 128, 295, 296, 204/252, 283; 162/153

[56] References Cited

U.S. PATENT DOCUMENTS 4,186,065 1/1980 Dilmore et al. ..... 204/98

FOREIGN PATENT DOCUMENTS 73885 6/1980 Japan ..... 204/51

*Primary Examiner*—R. L. Andrews

*Attorney, Agent, or Firm*—Edward J. Whitfield; Bruce H. Cottrell

[57] ABSTRACT

An electrolyte permeable asbestos diaphragm is prepared by depositing asbestos and a particulate thermoplastic polymeric material from an aqueous slurry including alkali metal hydroxide onto a porous substrate, and heating the deposited asbestos, particulate thermoplastic polymeric material, and alkali metal hydroxide for a period of time, e.g., at least 2 hours, and at temperatures sufficient to react the asbestos and alkali metal hydroxide but temperatures insufficient to melt or sinter the particulate thermoplastic polymeric material, whereby the particulate thermoplastic polymeric material functions to provide permeability for the diaphragm.

12 Claims, No Drawings

METHOD OF PREPARING AN ASBESTOS DIAPHRAGM

This is a continuation of application Ser. No. 813,326, filed Dec. 24, 1985, now abandoned.

BACKGROUND OF THE INVENTION

The present invention relates to methods of preparing asbestos diaphragms useful in electrolytic cells utilized for the electrolysis of aqueous salt solutions, especially useful in electrolytic cells utilized for the electrolysis of aqueous alkali metal halide solutions, e.g., sodium chloride brine.

Diaphragms are used in electrochemical processes to separate an anolyte liquor from a catholyte liquor while permitting the flow of electrolyte there through. Diaphragms are used, for example, to separate an oxidizing electrolyte from a reducing electrolyte, a concentrated electrolyte from a dilute electrolyte, or a basic electrolyte from an acidic electrolyte.

In the electrolysis of an aqueous alkali metal halide solution, the diaphragm separates an acidic anolyte from an alkaline catholyte. Historically, commercial chlor-alkali diaphragms have been made of asbestos. Such diaphragms have been prepared by vacuum-drawing a liquid slurry containing asbestos fibers onto a porous cathode thereby depositing a mat of asbestos on the cathode. Asbestos diaphragms typically are characterized by a short lifetime of about 6 to 8 months.

Numerous efforts have been made to improve the lifetimes and performances of asbestos diaphragms. For example, according to U.S. Pat. No. 3,991,251, asbestos diaphragms can be strengthened by vacuum-depositing the asbestos from an aqueous slurry containing sodium hydroxide and heating the diaphragm to a temperature between about 110° Centigrade (C.) and 280° C. for a sufficient period of time to react to the sodium hydroxide and the asbestos. However, such diaphragms can be too impermeable to the flow of electrolyte therethrough, thereby requiring a higher hydrostatic head of brine on the anolyte side of a diaphragm to maintain a desired electrolyte flow.

The following patents illustrate another technique of strengthening diaphragms by the use of materials, in particular fluorine-containing polymers, as binders with asbestos diaphragms. Generally, the technique includes mixing a slurry containing a particulate or fibrous binder material and asbestos fibers, depositing the solid materials as a mat on the porous cathode, and heating the diaphragm mat to sinter or melt the binder material, thereby effecting bonding between the asbestos and binder. For example, U.S. Pat. No. 4,065,534 describes the codeposition of a thermoplastic resin with asbestos followed by melting the resin to bind the asbestos. U.S. Pat. No. 4,070,257 describes the preparation of a diaphragm mat containing asbestos and a fluorine-containing resin binder, followed by sintering the resin by heating the diaphragm for about 1 to 10 minutes at a temperature in the range from the melting point to 100° C. above the melting point of the resin. U.S. Pat. No. 4,142,951 describes depositing a diaphragm of crocidolite asbestos, chrysotile asbestos and a polymeric fluorocarbon resin followed by heating to sinter the polymer resin and provide bonding between the asbestos and resin. U.S. Pat. No. 4,410,411 describes the codeposition of a fluorine-containing polymer and asbestos followed by heating at a temperature sufficient to fuse, soften, and flow the polymer and thereby bind the diaphragm. Finally, Japanese Patent No. 55/073885 (1980) describes codeposition of a fluorine-containing polymer and asbestos from a slurry containing alkali metal hydroxide, followed by heating at a temperature from 200° C. to 250° C. to allow bonding of the asbestos and alkali metal hydroxide, but without melting the polymer.

SUMMARY OF THE INVENTION

In accordance with the present invention, asbestos diaphragms can be prepared by providing an aqueous slurry including alkali metal hydroxide, asbestos and a particulate thermoplastic polymeric material, passing the slurry through a foraminous structure, e.g., a foraminous cathode, whereby a mat of asbestos, particulate thermoplastic polymeric material and alkali metal hydroxide is deposited thereon, and heating the mat for a period of at least two hours at temperatures sufficient to react the alkali metal hydroxide and asbestos, but at temperatures insufficient to melt or sinter the particulate thermoplastic polymeric material.

Further, in accordance with the present invention, asbestos diaphragms can be prepared by providing an aqueous slurry including alkali metal hydroxide, asbestos and a particulate nonfluorine-containing thermoplastic polymeric material, passing the slurry through a foraminous structure whereby a mat of asbestos, particulate nonfluorine-containing thermoplastic polymeric material and alkali metal hydroxide is depositad thereon, and heating the deposited mat at temperatures insufficient to melt or sinter the particulate nonfluorine-containing thermoplastic polymeric material, but at temperatures and for a period of time sufficient to react the alkali metal hydroxide and asbestos.

Further still in accordance with the present invention, a chlorotrifluoroethylene-ethylene copolymer resin material can be codeposited with asbestos from an aqueous slurry including alkali metal hydroxide, asbestos and the chlorotrifluoroethylene-ethylene copolymer onto a liquid permeable foraminous structure, e.g., a cathode member, and heat-treated at temperatures and for a period of time sufficient to react the asbestos and alkali metal hydroxide, but at temperatures insufficient to melt or sinter the copolymer resin.

The presently described methods of preparing a diaphragm provide a strengthened and substantially stable electrolyte permeable asbestos diaphragm that can be used in a chlor-alkali cell. A diaphragm of this invention can be utilized to electrolyze an alkali metal chloride brine in an electrolytic cell having an anolyte compartment with an anode therein, a catholyte compartment with a cathode therein and the electrolyte permeable asbestos diaphragm therebetween, the diaphragm being prepared by direct deposition onto the cathode by any of the described methods wherein the deposited diaphragm is heated at temperatures insufficient to melt or sinter the particulate thermoplastic polymeric material. The method of electrolyzing alkali metal chloride brine in an electrolytic cell with a diaphragm of this invention further includes feeding brine to the anolyte compartment, percolating brine through the asbestos diaphragm to the catholyte compartment, passing an alectric current from the anode to the cathode, and recovering chlorine and alkali metal hydroxide as products.

DETAILED DESCRIPTION OF THE INVENTION

According to one embodiment of this invention, an asbestos diaphragm can be prepared by providing an aqueous slurry containing alkali metal hydroxide, asbestos and a particulate thermoplastic polymeric material, passing the slurry through a foraminous substrate, e.g., a foraminous cathode, to deposit a mat of asbestos, particulate thermoplastic polymeric material and alkali metal hydroxide thereon, and heating the deposited mat for a period of at least two hours at temperatures sufficient to react the asbestos and alkali metal hydroxide, but at temperatures insufficient to melt or sinter the particulate thermoplastic polymeric material. While the mechanism is not precisely known, it is postulated that the heating step facilitates a reaction between asbestos and the alkali metal hydroxide whereby magnesium ions on the asbestos surface are displaced and alkali metal silicates are formed. While not wishing to be bound by any theory, it is believed some alkali metal silicate precipitates as silica gel upon initial contact with an acidic anolyte, providing a tough adherent silica layer which is substantially inert to anolyte liquor. That is, the silica layer is more inert to anolyte liquor than is a conventional diaphragm. Further, alkali metal silicate crystals are believed to bind together and strengthen the diaphragm.

According to another embodiment of this invention, an asbestos diaphragm can be prepared by providing an aqueous slurry containing alkali metal hydroxide, asbestos and a particulate nonfluorine-containing thermoplastic polymeric material, passing the slurry through a foraminous substrate, e.g., a cathode, to deposit a mat of asbestos, particulate nonfluorine-containing thermoplastic polymeric material and alkali metal hydroxide thereon, and heating the deposited mat at temperatures and for a period of time sufficient to react the alkali metal hydroxide and asbestos. Throughout the process, the temperature is insufficient to melt or sinter the particulate nonfluorine-containing thermoplastic polymeric material.

In yet another embodiment of this invention the particulate thermoplastic polymeric material is a chlorotrifluoroethylene-ethylene copolymer resin. An asbestos diaphragm can be prepared by providing an aqueous slurry including alkali metal hydroxide, asbestos and the particulate chlorotrifluoroethylene-ethylene copolymer material, passing the slurry through a foraminous substrate, i.e., a cathode, to deposit a mat of asbestos, alkali metal hydroxide and copolymer material, and heating the mat at temperatures and for a period of time sufficient to react the asbestos and alkali metal hydroxide, but at temperatures insufficient to melt or sinter the copolymer material.

The asbestos used in the diaphragm of this invention is most commonly chrysotile asbestos, although crocidolite, anthophylite, cristobalite, amphibole, and serpentine forms of asbestos may be used. Typically the asbestos can be selected from the various available grades, such as, Quebec Producers Association Quebec screen test grades 3T, 4T, 4D, and 4K or mixtures thereof and Vermont Asbestos Group grades $D_1$ and $D_2$ or mixtures thereof. The asbestos fibers are preferably of more than a single relatively uniform length. For best diaphragm performance it is preferred that asbestos fibers of at least two substantially different lengths be utilized in preparing the diaphragm. For example, the asbestos fibers may be selected from among the various asbestos grades to provide mixtures of long fibers with an average length of about ½ inch and short fibers with an average length of about ¼ inch.

Typically, the slurry contains from about 0.5 to about 3.0 weight percent solids, i.e., asbestos and particulate thermoplastic polymeric material, basis total weight of the liquid and solids and from about 1 to about 30 weight percent particulate thermoplastic polymeric material, basis total weight of asbestos and particulate thermoplastic polymeric material, more preferably from about 2 to about 15 weight percent particulate thermoplastic polymeric material. Concentrations of asbestos and particulate thermoplastic polymeric material lower than about 0.5 weight percent, while satisfactory in providing a diaphragm according to this invention, require large amounts of slurry in order to build up a satisfactory thickness of the diaphragm mat. A slurry having total asbestos and particulate thermoplastic polymeric material concentrations greater than about 3 weight percent generally does not process properly due to thickening of the slurry.

The asbestos slurry has a pH greater than 7 and preferably greater than about 10. An alkaline pH is provided by an aqueous solution containing hydroxide ion. The slurry medium may be provided by an aqueous solution of an alkali metal hydroxide, e.g., sodium hydroxide or potassium hydroxide, or may be provided by cell liquor, i.e., sodium hydroxide and sodium chloride, or potassium hydroxide and potassium chloride. Alternatively, the slurry medium may be an aqueous solution of sodium carbonate or potassium carbonate. Generally, the slurry contains from about 100 to about 200 grams per liter alkali metal hydroxide and, when cell liquor is utilized as the slurry medium, from about 100 to about 300 grams per liter alkali metal chloride. When the slurry medium is cell liquor, i.e., a sodium chloride and sodium hydroxide mixture, the slurry generally contains from about 110 to about 150 grams per liter of sodium hydroxide and from about 120 to about 200 grams per liter of sodium chloride.

According to the embodiments of this invention, the asbestos fibers and the particulate thermoplastic polymeric material are codeposited on a liquid permeable substrate. The codeposition may be accomplished by inserting the liquid permeable substrate into an aqueous slurry containing the asbestos, alkali metal hydroxide and the particulate thermoplastic polymeric material and drawing a vacuum within the substrate. The vacuum draws the slurry through the substrate, depositing a mat of asbestos and particulate thermoplastic polymeric material on the external surface of the substrate. The mat retains some residual slurry medium including some alkali metal hydroxide. By vacuum is meant producing a pressure differential between the outside of the liquid permeable substrate and the inside of the liquid permeable substrate. Typically, a vacuum of from about 15 to about 25 inches of mercury is built up and maintained within the liquid permeable substrate for a period of from about 10 to about 90 minutes. In this way, a diaphragm can be deposited having a weight of solids of from about 0.2 to about 0.4 pounds per square foot of diaphragm surface area. According to one desirable practice, a vacuum of about 1.5 inches of mercury is maintained for several minutes and thereafter the vacuum is increased to about 2.5 inches and maintained thereat for several minutes. Gradually the vacuum is increased further to about 15 inches of mercury and maintained thereat for about 1 minute. Thereafter, the vacuum is increased still further to about 27 to 29 inches of mercury and maintained thereat until approximately 0.2 to 0.4 pounds of asbestos and particulate thermoplastic polymeric material per square foot of substrate area deposited.

Other methods of depositing the diaphragm onto the substrate, e.g., a foraminous cathode, include the use of gravity flow or positive pressure to force the slurry against the porous surface, thereby depositing the solids in the form of a mat or web while the liquid slurry medium flows through the porous surface. Alternatively, the diaphragm mat or web may be prepared on a surface other than the cathode surface (such as by using a Fourdrinier process) and then transferred to the cathode surface.

The diaphragm of this invention is deposited upon a porous substrate usually a porous metallic cathode. The porous or foraminous cathode is electroconductive and may be a perforated sheet, a perforated plate, metal mesh, expanded metal mesh, metal rods or the like. For example, the openings in the foraminous cathodes commercially used today in chlor-alkali cells are usually about 0.05 to 0.125 inches in size. Most commonly, the cathode will be of iron or an iron alloy. By iron alloy is meant a carbon steel or other alloy of iron. Alternatively, the cathode can be nickel or other cell environment resistant electroconductive material. Cathodes suitably used in this invention include those having an activated surface coating, for example, those cathodes with a porous Raney nickel surface coating. Raney nickel coatings can provide a reduction of hydrogen over-voltage at the cathode and allow a significant savings in energy consumption and cost in the electrolysis of brine. Raney nickel coatings can be provided by various expedients well known to those skilled in the art.

The particulate thermoplastic polymeric material can be any such material thermally stable so as to provide porosity and permeability to the diaphragm following the heat treatment in which the asbestos and alkali metal hydroxide are reacted. The particulate tharmoplastic polymeric material should remain in particulate form without melting, fusing or sintering during the heat treatment. The particulate thermoplastic polymeric material may generally be selected from hydrocarbon materials, halocarbon homopolymers, and hydrocarbon and halocarbon copolymers. The particulate thermoplastic polymeric material may be a nonfluorine-containing material, e.g., a hydrocarbon homopolymer such as, polyethylene, polypropylene, or polystyrene, a hydrocarbon copolymer such as a copolymer of styrene and ethylene, a copolymer of styrene and isobutylene, or a copolymer of ethylene and isobutylene, and a hydrocarbon polymer such as polycarbonate, polyacenaphthylene, poly(phenylene sulfide), polysulfane, poly(1,4-butylene terephthalate), and poly(2,6-diemthyl-1,4-phenylene oxide).

Halocarbon homopolymers may be utilized as the particulate thermoplastic polymeric material and can contain chloride, fluorine, and hydrogen or mixtures thereof. For example, the halocarbon homopolymer may be polyvinyl chloride, polyvinylidene chloride, polytrichloroethylene, poly(1-chloro,-2,2-difluoroethylene), poly(1-chloro-1,2-difluoroethylene), polytrifluoroethylene, polyvinyl fluoride, and polyvinylidene fluoride. Alternatively, copolymers having hydrocarbon and halocarbon moieties may be used as the particulate thermoplastic polymeric material with the halocarbon moieties containing chlorine, fluorine, and hydrogen or mixtures thereof. For example, such copolymers may include as halocarbon moieties, vinyl fluoride, vinylidene fluoride, trifluoroethylene, perfluoroethylene, vinyl chloride, vinylidene chloride, and chlorotrifluoroethylene. The copolymer may be a graft copolymer, a block copolymer, an alternating copolymer, or a random copolymer. Typically, in such hydrocarbon and halocarbon copolymers, the hydrocarbon moiety will be ethylene or butylene. A particularly outstanding halocarbon and hydrocarbon copolymer useful as the particulate thermoplastic polymeric material is poly(ethylene-chlorotrifluoroethylene), an alternating copolymer of ethylene and chlorotrifluoroethylene, available from Allied Chemical Corporation under the tradename Halar®. Another particularly suitable halocarbon-hydrocarbon copolymer is poly(ethylene-tetrafluoroethylene), an alternating copolymer of ethylene and tetrafluoroetylene, available under the trademark Tefzel®.

The thermoplastic polymer material, whether as a nonfluorine-containing material such as, e.g., polypropylene or polystyrene, or a fluorine-containing material such as, e.g., a chlorotrifluoroethylene-ethylene copolymer or a tetrafluoroethylene-ethylene copolymer is utilized in a particulate form. By particulate is meant as granules or particles with a size range of 0.01 to 250 microns in diameter or as fibers with a fiber length of up to about ¾ inch and diameters of about 0.01 to 250 microns.

Following deposition of a mat of asbestos, particulate thermoplastic polymeric material and alkali metal hydroxide upon the foraminous structure, the deposited mat generally retains some residual liquid slurry medium. The residual liquid slurry medium retained by the diaphragm provides the alkali metal ions necessary for the reaction with the asbestos. Alkali metal ions are most conveniently provided by the alkali metal hydroxide in the aqueous slurry. The deposited mat will generally retain from about 30 percent to 60 percent by weight liquid slurry medium based on the total weight of the deposited mat. Sufficient alkali metal hydroxide for the reaction is generally present when the mat is slightly damp to the touch.

In the embodiments of the invention, the method of preparing the electrolyte permeable asbestos diaphragm can also include maintaining a flow of inert gas through the deposited mat while the mat is heated at temperatures sufficient to react the alkali metal hydroxide and asbestos, but insufficient to melt or sinter the particulate thermoplastic polymeric material. By inert is meant that gas does not undergo chemical reaction. The gas can be an inert gas such as, e.g., nitrogen or most conveniently can be air. The flow rate of inert gas tbrough the diaphragm is a function of the pressure differential across the diaphragm, the porosity of the diaphragm, and the thickness of the diaphragm. For example, air may be drawn through the mat by applying a low vacuum, e.g., a vacuum of from about 2 inches of mercury to about 15 inches of mercury to the inside of the foraminous structure during the heating of the mat. Maintaining an air flow through the diaphragm during heating assists in controlling the porosity and permeability of the diaphragm to desired levels.

In the preparation of a diaphragm according to this invention, the asbestos mat is heated to temperatures sufficient to react the alkali metal hydroxide and asbestos, but to temperatures insufficient to melt or sinter the particulate thermopastic polymeric material. This reaction may be accomplished by heating the asbestos mat to a temperature between about 110° C. and about 280° C., preferably between about 140° C. and 220° C., most preferably between about 150° C. and 190° C. and maintaining the mat at the reaction temperature for a period of time sufficient to achieve reaction. For example, the mat may be maintained at a single temperature between about 110° C. and about 280° C., preferably between about 140° C. and 220° C. or the mat may be maintained at a sequence of temperatures from about 110° C. to 280° C., more preferably between about 140° C. and 220° C. and most preferably between about 150° C. and 190° C. Preferably, the mat is gradually heated from ambient temperature to a finally selected temperature within the desired temperature range. A gradual rise in temperature may help avoid any boiling of residual liquid within the diaphragm mat and avoid blistering of the diaphragm.

The asbestos mat can be maintained in the desired temperature range for a period of time sufficient to react the asbestos and alkali metal hydroxide and provide a tough physically stable diaphragm. Sufficient periods of time for this reaction to occur will be generally at least two hours, for example, from about 2 to 6 hours or longer. The Particulate thermoplastic polymeric material improves permeability and porosity within the diaphragm following the heating stage and the resultant diaphragm can be readily utilized in place of conventional asbestos diaphragms. While not wishing to be bound by any theory, it is believed the particulate thermoplastic polymeric material may function as a propping agent during the heat treatment thereby providing fractures or passageways to provide diaphragm permeability.

The diaphragm prepared by the method of this invention has a porosity and permeability that allows brine subjected to a pressure gradient to flow through the diaphragm at a rate from about 0.01 to about 0.15 cubic centimeters per square centimeter of diaphragm surface area per minute. The pressure gradient is typically the result of a hydrostatic head on the anolyte side of an electrolytic cell, e.g., a differential level in the anolyte compartment on the order of about 3 to about 80 inches, whereby to provide a cell liquor containing from about 10 to 12 weight percent alkali metal hydroxide and about 10 to 15 weight percent alkali metal chloride at a current efficiency of about 90 percent or above. Differential level is the difference between the brine feed level in the anolyte compartment and the cell liquor level in the catholyte compartment. The diaphragm preferably operates with a differential level of about 3 to about 80 inches, more preferably from about 12 to about 45 inches. Sometimes it may be advantageous to have the chlorine gas above atmospheric pressure in the anolyte compartment thereby to increase the pressure gradient.

After a diaphragm of this invention is prepared, it can be assembled into an electrolytic cell. Such a cell can include an anode in an anolyte compartment, a foraminous cathode in a catholyte compartment, and the electrolyte permeable asbestos diaphragm therebetween and upon the foraminous cathode. The electrolytic cell can then be utilized to electrolyze alkali metal chloride brine to produce alkali metal hydroxide and chlorine. The electrolysis of the alkali metal chloride brine consists of feeding brine to the anolyte compartment of the electrolytic cell, applying a hydrostatic head or pressure to the brine in the anolyte compartment, whereby electrolyte is percolated through the diaphragm, passing electric current from the anode to the cathode, and recovering alkali metal hydroxide and chlorine as products from the cell.

In the embodiment of the present invention wberein the particulate thermoplastic polymeric resin is codeposited with the asbestos from an aqueous slurry including alkali metal hydroxide, e.g., sodium hydroxide, the deposited mat is heated for at least two hours, usually at least 4 hours and most often from at least 6 to 16 hours at temperatures sufficient to react the sodium hydroxide and the asbestos but temperatures insufficient to melt or sinter the polymeric material. The deposited diaphragm is preferably heated at temperatures between about 140° C. and 220° C., more preferably between about 150° C. and about 190° C.

In the embodiment of the present invention, wherein the aqueous slurry contains sodium hydroxide, asbestos and a poly(ethylene-chlorotrifluoroethylene) resin (available as Halar® from Allied Chemical Corporation) as the particulate thermoplastic polymeric material, the slurry is passed through a foraminous metallic cathode by drawing a vacuum from within the cathode substrate whereby a mat of asbestos, polymeric resin and retained sodium hydroxide is deposited thereon. The deposited mat is heated at temperatures insufficient to melt or sinter the resin, i.e., temperatures beneath about 245° C. for a period of time sufficient to react the sodium hydroxide and asbestos. Preferably, the deposited mat is heated at temperatures between about 140° C. and 220° C., more preferably between about 150° C. and about 190° C. Lower heating temperatures can be advantageous in that the cathode structure will be subjected to lower temperatures and undergo reduced stress from thermal expansion. The diaphragm can be allowed to cool to ambient temperature, placed into a electrolytic cell and operated to electrolyze sodium chloride brine, whereby to produce sodium hydroxide and chlorine.

Finally, in the embodiment wherein the particulate thermoplastic polymeric material is nonfluorine-containing resin, the deposited diaphragm mat is heated at temperatures and for a period of time sufficient to react the sodium hydroxide and asbestos but temperatures below the melting or sintering point of the resin. With a nonfluorine-containing resin, such as polypropylene (which melts or sinters at temperatures above about 170° C.), the temperature range of heating is from about 140° C. to below the melting or sintering temperature, preferably from about 140° C. to 160° C. The heating period with the nonfluorine-containing materials is generally any time period sufficient to react the asbestos and sodium hydroxide, usually at least 2 hours, and most often from about 6 to 16 hours.

The following examples are illustrative of the present invention. Many modifications and variations of the present invention are possible in light of the present disclosure. It is therefore to be understood that the invention may be practiced otherwise than as specifically described and is limited only by the claims attached hereto.

EXAMPLE 1

An asbestos diaphragm was prepared with a particulate thermoplastic polymeric material of ethylene-chlorotrifluoroethylene copolymer and tested in a laboratory chlor-alkali cell.

An aqueous slurry was prepared containing 1.4 grams (g) of long asbestos fibers (grade 3T), 7.6 g of short asbestos fibers (grade 4K), 1.0 g of an ethylene-chlorotrifluoroethylene copolymer (Halar® 5004 available from Allied Chemical Corporation) and 500 ml of aqueous cell liquor (15 percent by weight sodium chloride and 10 percent by weight sodium hydroxide). A small portion of a surfactant, (Merpol® SE available from DuPont), i.e., less than 0.01 weight percent of the total slurry, was added with the copolymer.

The slury was aged for two days. Immediately prior to deposition, the slurry was agitated for 1 hour. Following the agitation, the slurry was vacuum deposited on a 3 inch by 3 inch mild steel wire mesh cathode having 6 mesh per inch mild steel wire, and approximately 60 percent open area. The vacuum applied during deposition was as follows: 0 inches mercury (Hg) for the first 5 minutes, 3 inches Hg for five minutes, a gradually increase between 3 and 27 inches Hg over 2 minutes, 27 inches Hg for 5 minutes to remove substantially all the liquids, and 25 inches Hg for 30 minutes to provide limited air drying. The deposited diaphragm remained slightly damp with the retention of a small amount of the cell liquor. The diaphragm and cathode assembly was placed into an oven at room temperature (about 20° C.). After remaining at room temperature for 12 hours, the oven temperature was raised to about 104° C. over a 30 minute period, maintained at about 104° C. for 3 hours, raised to about 182° C. over a 7 hour period at about 11° C. per hour, raised to 218° C. over a one hour period and finally maintained at about 218° C. for two hours. The diaphragm-cathode assembly was removed from the oven and allowed to cool. The resulting diaphragm had a weight of about 0.35 pounds per square foot of diaphragm surface area.

The cathode and diaphragm were installed in a laboratory test cell with a ruthenium dioxide-titanium dioxide coated titanium mesh anode spaced about 0.25 inch from the cathode. Electrolysis of a sodium chloride brine was commenced at a current density of 190 amperes per square foot (ASF). After 106 days of electrolysis, the following average results were obtained: cathode current efficiency 95.1 percent; cell voltage 3.29 volts; brine head differential level 15.7 inches; and catholyte liquor product 10.9 weight percent sodium hydroxide.

EXMAPLE 2

An asbestos diaphragm was prepared and operated substantially as in Example 1 except that only about 0.5 g of ethylenechlorotrifluoroethylene copolymer was added to the slurry and the total asbestos was about 9.5 g. After 97 days of electrolysis, the following average results were obtained: cathode current efficiency 95.3 percent; cell voltage 3.16 volts; brine head differential level 12.7 inches; and catholyte liquor product 10.5 weight percent sodium hydroxide.

EXAMPLE 3

An asbestos diaphragm having a weight of about 0.34 pounds per square foot of diaphragm surface area, was deposited from an aqueous slurry with about 10 percent by weight ethylene-chlorotrifluoroethylene copolymer, basis total weight of copolymer and asbestos, upon a 3-inch by 3-inch mild steel wire mesh cathode as in Example 1. The diaphragm and cathode assembly were heated under a vacuum of between 7 and 15 inches of Hg to maintain an air flow through the diaphragm during heating. The diaphragm was heated in an oven as follows: the oven temperature was raised to about 104° C. for 30 minutes, maintained at about 104° C. for 3 hours, and maintained at about 177° C. for 2 hours. The diaphragm-cathode assembly was removed from the oven, allowed to cool and operated substantially as in Example 1. After 21 days of electrolysis, the followed results were obtained: cathode current efficiency 95.8 percent; cell voltage 3.28 volts; brine head differential level 10.5 inches; and catholyte liquor product 10.4 weight percent sodium hydroxide.

EXAMPLE 4

An asbestos diaphragm was prepared with polypropylene as a particulate nonfluorine-containing thermoplastic polymeric material. The diaphragm was deposited from aqueous cell liquor (15 weight percent sodium chloride and 10 weight percent sodium hydroxide) containing about 1.5 weight percent solids, i.e., asbestos fibers and polypropylene powder. The polypropylene was about 10 weight percent of the total weight of solids in the slurry. The deposited diaphragm was heated in an oven with a vacuum applied to the cathode and diaphragm. Initially, the applied vacuum was 15 inches Hg. The oven temperature was raised to about 104° C. over a 30 minute period, raised to about 110° C. over a 30 minute period, maintained at about 110° C. for a 45 minute period, raised to about 150° C. over an hour period and maintained at about 150° C. for 13 hours. The diaphragm was operated in a cell substantially as in Example 1. After 19 days of electrolysis, the following average results were obtained: cathode current efficienc 93.8 percent; cell voltage 3.02 volts; brine head differential level 11.9 inches; and catholyte liquor product 10.1 weight percent sodium hydroxide.

I claim:

1. A method of depositing a liquid permeable asbestos diaphragm on a formainous cathode structure by the steps of:

(a) providing an aqueous slurry containing from about 100 to about 200 grams per liter alkali metal hydroxide and from about 0.5 to about 3 weight percent, basis total weight of slurry, of asbestos and particulate thermoplastic polymeric material the particulate thermoplastic polymeric material being present in amount of from about 1 to about 30 weight percent basis total weight of asbestos and particulate thermoplastic polymeric material.

(b) contacting a foraminous cathode structure with the slurry so as to deposit on the foraminous cathode structure a mat containing alkali metal hydroxide, asbestos and particulate thermoplastic polymeric material;

(c) heating the foraminous cathode structure having the mat deposited thereon at temperature in the range of from about 110° C. to about 190° C. for at least two hours so as to react the alkali metal hydroxide with the asbestos, with theproviso that the heating temperature is below the melting point or sintering point of the particulate thermoplastic polymeric material.

2. The method of claim 1 wherein the heating temperature is in the range of from about 150° C. to about 190° C.

3. The method of claim 1 wherein the thermplastic polymeric material is non-fluorine containing.

4. The method of claim 3 wherein the non-fluorine containing thermoplastic polymeric material is polypropylene.

5. The method of claim 1 wherein the thermoplastic polymeric material is fluorine containing.

6. The method of claim 5 wherein the fluorine containing thermoplastic polymeric material is a copolymer of chlorotrifluoroethylene and ethylene.

7. The method of claim 1 wherein the alkali metal hydroxide is sodium hydroxide.

8. The method of claim 1 wherein the slurry contains alkali metal chloride.

9. The method of claim 8 wherein the alkali metal chloride is sodium chloride.

10. The method of claim 1 wherein a flow of inert gas is maintained through the deposited mat during heating.

11. In an electrolytic cell having an anode disposed in an anolyte compartment, a cathode disposed in a catholyte compartment and a liquid permeable asbestos diaphragm disposed therebetween and deposited on the foraminous cathode wherein the diaphragm-cathode structure is one prepared by the method defined in claim 1.

12. In a method of producing chlorine and alkali metal hydroxide in a electrolytic cell by feeding aqueous alkali metal chloride solution into the anolyte compartment of the cell having an anode disposed therein, percolating the brine through a liquid permeable asbestos diaphragm into a catholyte compartment having a foraminous cathode disposed therein and recovering chlorine and alkali metal hydroxide products from the cell, the asbestos diaphragm having been deposited on the foraminous cathode according to the method defined in claim 1.

* * * * *